US007400843B2

(12) United States Patent
Nakaya

(10) Patent No.: US 7,400,843 B2
(45) Date of Patent: Jul. 15, 2008

(54) COLOR IMAGE FORMING APPARATUS

(75) Inventor: Yukiko Nakaya, Kounan (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 215 days.

(21) Appl. No.: 11/427,609

(22) Filed: Jun. 29, 2006

(65) Prior Publication Data

US 2007/0003319 A1 Jan. 4, 2007

(30) Foreign Application Priority Data

Jun. 30, 2005 (JP) ..... 2005-192048

(51) Int. Cl.
*G03G 15/08* (2006.01)

(52) U.S. Cl. ..... 399/102; 399/103; 399/105

(58) Field of Classification Search ..... 399/102, 399/103, 105, 106, 302, 303
See application file for complete search history.

(56) References Cited

U.S. PATENT DOCUMENTS 6,356,723 B1 3/2002 Sato et al.
6,496,669 B2 12/2002 Sato et al.
7,310,488 B2 * 12/2007 Kitamura ..... 399/102

FOREIGN PATENT DOCUMENTS

| | | | |
|---|---|---|---|
| JP | 11-272089 | A | 10/1999 |
| JP | 2001-060040 | A | 3/2001 |
| JP | 2001-305828 | A | 11/2001 |
| JP | 2002-055544 | A | 2/2002 |
| JP | 2003-241515 | A | 8/2003 |
| JP | 2004-272118 | A | 9/2004 |

* cited by examiner

*Primary Examiner*—Hoang Ngo
(74) *Attorney, Agent, or Firm*—Banner & Witcoff, Ltd.

(57) ABSTRACT

A color image forming apparatus may include photoconductors, developing rollers, and cases, each configured to hold developer to be supplied to a corresponding photoconductor from a corresponding developing roller, and each having an elongated opening in which the developing roller is disposed. Also included are a side seal member disposed at each end of the elongated opening in a longitudinal direction of the opening, each side seal member contacting a peripheral surface of the developing roller at each end of an axial direction of the developing roller, and a belt configured to move in a transporting direction parallel to an arrangement direction of the photoconductors, the belt being disposed below the developing rollers. The belt can be disposed to avoid contacting the photoconductors in an area defined by the side seal members being projected onto a plane on a surface of the belt parallel to an axis of the photoconductors.

8 Claims, 5 Drawing Sheets

COLOR IMAGE FORMING APPARATUS

CROSS REFERENCE TO RELATED APPLICATION

This application claims priority from Japanese Patent Application No. 2005-192048, filed on Jun. 30, 2005, the entire subject matter of which is incorporated herein by reference.

FIELD

The invention relates to a color image forming apparatus, such as a color laser printer.

BACKGROUND

A known tandem image forming apparatus includes photoconductors in association with each color of yellow, magenta, cyan and black. Such a tandem image forming apparatus can print in color at substantially the same speed as printing in monochrome, because the photoconductors are provided in association with each of the colors.

As disclosed in, for example, Japanese Laid-Open Patent Publication No. 2001-305828, a tandem color image forming apparatus is provided with image forming units, each including a developing roller and a photoconductor, arranged in the horizontal direction. In the color image forming apparatus, the width of an intermediate transfer belt is set smaller than the length of the photoconductor to reduce slidable contact between the intermediate transfer belt and the photoconductor edges. Thus, the intermediate transfer belt is prevented from being damaged or broken by a grounding layer of the photoconductor.

In the color image forming apparatus, toner carried on the developing roller may sometimes leak from the image forming units and drop onto the intermediate transfer belt. The toner dropped onto the belt is generally collected by a cleaning unit. The width of the cleaning unit is greater than the width of the intermediate transfer belt.

To reduce the size of the image forming apparatus, it would be desirable to downsize the cleaning unit such that the width of the cleaning unit becomes smaller than the width of the intermediate transfer belt.

If the toner dropped from one image forming unit onto the intermediate transfer belt is conveyed to a photoconductor of another image forming unit disposed downstream of the image forming unit in a traveling direction of the intermediate transfer belt, the toner may be adversely transferred onto the photoconductor. If the toner adversely transferred onto the photoconductor is collected by the developing roller, the color toner contained in one image forming unit, which leaks the toner therefrom, is mixed into the other image forming unit disposed downstream of the image forming unit. Thus, the toner of different colors is mixed, resulting in the contamination of the toner of the other image forming unit. If a side sealing member slides with a peripheral surface of the developing roller at its each end, the side seal member is contaminated with the different color toner.

SUMMARY

According to illustrative aspects of the invention, a color image forming apparatus is provided that prevents a developer from adhering to a photoconductor disposed on a downstream side in a belt moving direction, even when the developer leaks from a case through a side seal member.

BRIEF DESCRIPTION OF THE DRAWINGS

Illustrative aspects of the invention will be described in detail with reference to the following figures in which like elements are labeled with like numbers and in which.

DETAILED DESCRIPTION

Illustrative aspects of the invention will be described in detail with reference to the accompanying drawings.

1. General Structure of Color Laser Printer

Figure 1:
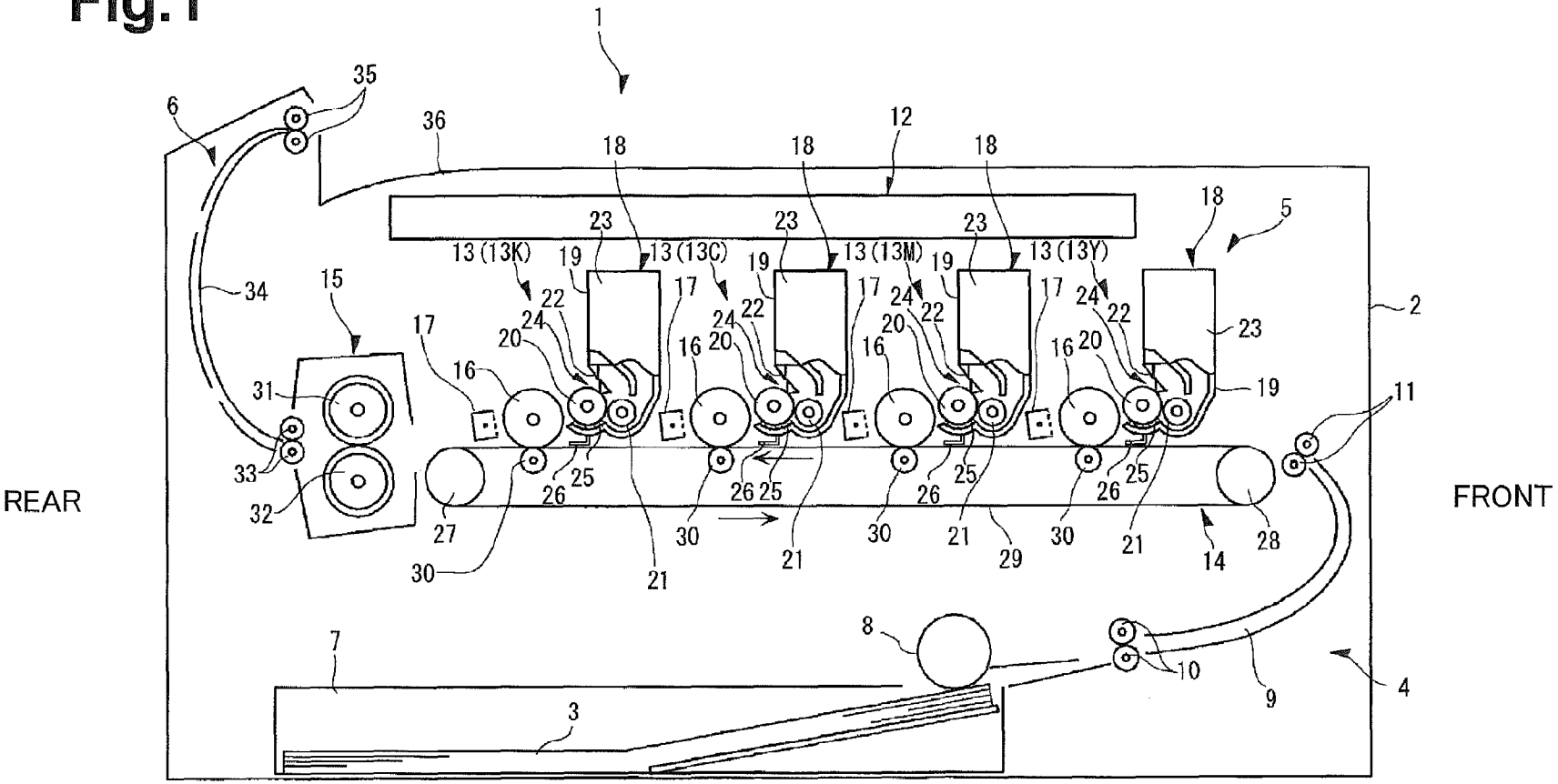
FIG. 1 is a sectional side view of a color laser printer, as an image forming apparatus, according an aspect of the invention.

In FIG. 1, a color laser printer 1 is a tandem color laser printer in which process units 13 are arranged in tandem with each other in a horizontal direction (left and right side direction in FIG. 1). The color laser printer 1 is provided in a box-shaped main body casing 2 with a sheet feeding unit 4 configured to feed sheets 3 (recording mediums), an image forming unit 5 configured to form an image on the fed sheets 3, and a sheet output unit 6 configured to output the sheets 3 having an image formed thereon.

(1) Sheet Feeding Unit

The sheet feeding unit 4 includes a sheet supply tray 7 disposed at a bottom portion of the main body casing 2, a pick-up roller 8 disposed at a front upper portion of the sheet supply tray 7, a sheet feed path 9 extending from in front of the pick-up roller 8 above the pick-up roller 8 to register rollers 11, a pair of conveying rollers 10 disposed on the sheet feed path 9 and a pair of a register rollers 11 disposed at a downstream end of the sheet feed path 9.

In the sheet supply tray 7, the sheets 3 are stacked. An uppermost sheet 3 is supplied to the sheet feed path 9 by the rotation of the pick-up roller 8. The pick-up roller 8 is intended to pick up and supply one sheet at a time when driven.

The sheet feed path 9 is formed in a substantially "U" shaped manner so as to feed the sheet 3 frontward and then rearward along the U-shaped sheet feed path 9. The upstream end of the sheet feed path 9 with respect to a sheet feeding direction is disposed adjacent to the pick-up roller 8 at a lower position. The downstream end of the sheet feed path 9 with respect to a sheet feeding direction is disposed at a position above and adjacent to a conveying belt 29 as will be described below.

The sheet 3 fed to the sheet feed path 9 is conveyed by the conveying rollers 10 in the sheet feeding direction while being U-turned. Then, the sheet 3 is registered by the register rollers 11 to reduce the skew of the sheet 3 and fed rearward by the register rollers 11 to a position above and adjacent to the conveying belt 29.

(2) Image Forming Unit

The image forming unit 5 includes a scanner unit 12, the process units 13, a transfer section 14, and a fixing section 15.

(3) Scanner Unit

The scanner unit 12 is disposed at an upper portion of the main body casing 2 above the process units 13. The scanner unit 12 is provided, according to colors of toner, with an optical device. The optical device may be a light source of, for example, a semiconductor laser, a polygon mirror, an f-theta lens, a reflecting mirror, and a toric lens, which are not shown. The laser beam emitted from the respective light source based on image data is deflected by the polygon mirror. The laser beam passes through the f-theta lens and the toric lens and is reflected off the reflecting mirror, to scan across the surface of the photoconductive drums 16 (described below) of the process units 13 at high speed.

(4) Process Unit

The process units 13 are provided in association with several colors of toner. More specifically, the process units 13 include a yellow process unit 13Y, a magenta process unit 13M, a cyan process unit 13C, and a black process unit 13K. The process units 13Y, 13M, 13C, 13K are arranged in tandem in the horizontal direction with some distance therebetween in the front-rear direction.

Each process unit 13Y, 13M, 13C, 13K includes the photoconductive drum 16, as a photoconductor, a scorotron charger 17 and a developing cartridge 18.

Each photosensitive drum 16 includes a cylindrical body coated with a positively chargeable photoconductive layer formed of, for example, polycarbonate and a drum shaft disposed at an axis of the drum body along its axial direction. The drum body is rotatable on the drum shaft. The drum shaft is fixedly supported by side walls of the main body casing 2. During image formation, the photoconductive drum 16 rotates in the counterclockwise direction in FIG. 1, so that it moves in the same direction as a moving direction of the conveying belt 29 at a contact position between the photoconductive drum 16 and the conveying belt 29.

The charger 17 is a positively charging scorotron charger including a wire and a grid electrode. The charger 17 generates a corona discharge by the application of charge bias. The charger 17 is disposed behind the photoconductive drum 16 with some distance therebetween to prevent the charger 17 from contacting the drum 16.

The developing cartridge 18 is disposed in front of the photoconductive drum 16. The developing cartridge 18 includes a case 19, and a developing roller 20, a supply roller 21, and a layer thickness regulating blade 22 that are disposed in the case 19.

The case 19 is formed into a box shape, having a toner chamber 23 configured to contain the toner. A slot 24 (e.g., rectangular) elongated along an axial direction of the developing roller 20 is formed on the rear face of the case 19 at a position to face the photoconductive drum 16.

The developing roller 20 is disposed in the case 19 such that a part of the peripheral surface of the developing roller 20 is exposed from the slot 24. The developing roller 20 faces the front face of the photoconductive drum 16 and is pressed against the photoconductive drum 16. The developing roller 20 includes a metal roller shaft covered with a roller portion made of an elastic member, such as conductive rubber. More specifically, the roller portion of the developing roller 20 includes an elastic roller layer formed of, for example, conductive urethane rubber, silicone rubber or EPDM (ethylene propylene dine monomer) rubber including fine carbon particles, and a coating layer formed of, for example, urethane rubber, urethane resin, or polyimide resin, as a main intergradient, on the surface of the roller layer. The roller shaft of the developing roller 20 is rotatably supported by the side walls of the case 19 and developing bias is applied thereto during image formation.

The supply roller 21 faces the front face of the developing roller 20 and is pressed against the developing roller 20. The supply roller 21 includes a metal roller shaft covered with a roller portion made of a conductive sponge. The roller shaft of the supply roller 21 is rotatably supported by the side walls of the case 19.

The layer thickness regulating blade 22 is made of a metal leaf spring. A pressing portion having a generally semicircular shape in cross section is made of insulating silicone rubber and provided at an end of the metal leaf spring. The blade 22 is supported by the case 19 of the developing cartridge 18 above the developing roller 20. The pressing portion disposed at a lower end of the blade 22 is pressed against an upper front portion of the developing roller 20.

Each toner chamber 23 contains color toner. More specifically, the toner chambers 23 of the yellow, magenta, cyan, and black process units 13Y, 13M, 13C, 13K contain, for example, positively chargeable non-magnetic single component yellow, magenta, cyan, and black toner, respectively.

The toner of each color is a polymerized toner having substantially spherical particles obtained through copolymerization. The polymerized toner has binder resin as the main ingredient, which is obtained through copolymerization of styrene-based monomers, such as styrene, and acryl-based monomers, such as acrylic acid, alkyl (C1-C4) acrylate, and alkyl (C1-C4) methacrylate, using a known polymerization method, such as suspension polymerization. A coloring agent, a charge control agent, and wax are added to the polymerized toner to form toner base particles. An external additive is also added to the polymerized toner to improve flowability.

As a coloring agent, each coloring agent of yellow, magenta, cyan, and black is formulated. As a charge control agent, combined is a charge control agent obtained through copolymerization of ion-based monomers having an ionized functional group, such as ammonium salt, and monomers that can be copolymerized with ion-based monomers, such as styrene-based monomers and acryl-based monomers. As an external additive, combined is inorganic powder, such as metallic oxide powder, carbonized powder, and metal salt powder. The metallic oxide powder may include silica, aluminum oxide, titanium oxide, strontium titanate, ceric oxide, and magnesium oxide.

When an image is formed, the color toner contained in the toner chambers 23 is supplied to the relevant supply rollers 21. The toner is then supplied to the relevant developing rollers 20 by the rotation of the supply rollers 21. At this time, the toner is positively charged by the friction between the supply roller 21 and the developing roller 20 to which developing bias is applied. The toner supplied onto the developing roller 20 passes between the layer thickness regulating blade 22 and the developing roller 20 while the developing roller 20 is rotating. The toner is carried on the developing roller 20 as a thin layer whose thickness has been uniformly regulated.

Side seal members 25 that seal a portion between the case 19 and an end of the peripheral surface of the developing roller 20 are provided at each end of the slot 24 with respect to the longitudinal direction of the slot 24, which is formed on the case 19. The side seal member 25 is formed of sponge material, such as urethane foam. The side seal members 25 are provided in a curve in association with the peripheral surface of the developing roller 20 so as to contact each end of the peripheral surface of the developing roller 20.

A container 26 is disposed below each end of the slot 24 of the case 19 for receiving and containing the toner leaking from a portion between the case 19 and an end of the peripheral surface of the developing roller 20. The container 26 is disposed so as to face the side seal member 25 in the vertical direction. The container 26 is formed into a substantially L shape in cross section, extending downward from the lower surface of the case 19 and then rearward.

Each charger 17 generates a corona discharge by applying charge bias to positively and uniformly charge the surface of each photoconductive drum 16. After the surface of each photoconductive drum 16 is positively and uniformly charged by each charger 17 while each drum 16 rotates, the surface of each drum 16 is exposed to the laser beam emitted from the scanner unit 12 at high speed. Thus, an electrostatic latent image of each color corresponding to an image to be formed on the sheet 3 is formed on the surface of each photosensitive drum 16.

As the toner, which is carried on the developing roller 20 and is positively charged, is brought into contact with each photosensitive drum 16 by the rotation of the developing roller 20 while the drum 16 rotates, the toner is supplied to parts of each photosensitive drum 16 selectively exposed to the laser beam where the potential level is lower than the remaining part of each photosensitive drum 16 surface that remains uniformly positively charged. Thus, the electrostatic latent image on each drum 16 is made visible and a toner image of each color is formed on the relevant photosensitive drums 16 by reverse image developing.

(5) Transfer Section

The transfer section 14 is disposed in the main body casing 2 along the front-rear direction above the sheet supply tray 7 below the process units 13. The transfer section 14 includes a drive roller 27 and a driven roller 28 as transporting rollers, and a conveying belt 29 and transfer rollers 30.

The drive roller 27 is disposed behind and below the drum 16 of the black process unit 13Y. When an image is formed, the drive roller 27 rotates in the direction (counterclockwise direction in FIG. 1) opposite to the rotating direction of the photoconductive drums 16.

The driven roller 28 is disposed in front of and below the photoconductive drum 16 of the yellow process unit 13Y. The drive roller 28 is disposed opposite the drive roller 27 with respect to the front-rear direction. When the drive roller 27 is driven, the driven roller 28 rotates in the same direction (counterclockwise direction in FIG. 1) as the drive roller 27.

The conveying belt 29 is an endless belt. The conveying belt 29 is formed of conductive resin, such as polycarbonate and polyimide, in which conductive particles, for example, carbon particles are dispersed. The conveying belt 29 is stretched between the drive roller 27 and the driven roller 28 so as to make contact with the photosensitive drums 16 of the process units 13 at its outer contact surface.

The driven roller 28 is rotated by the drive roller 27. The conveying belt 29 is circulated in the direction (counterclockwise direction) as indicated by arrows in FIG. 1, so as to move in the same direction as the photoconductive drums 16 on the contact surface where each photoconductive drum 16 of the process units 13 contacts the conveying belt 29, between the drive roller 27 and the drive roller 28. In other words, the conveying belt 29 moves in the direction as indicated by the arrows in FIG. 1, along an arrangement direction of the four photoconductive drums 16 (along the front-rear direction).

The transfer roller 30 is disposed opposite to each of the photoconductive drums 16 on an inner surface of the conveying belt 29, which loops around the drive and driven rollers 27, 28. The conveying belt 29 is interposed between the drum 16 and the transfer roller 30. The transfer roller 30 includes a metal roller shaft covered with a roller portion made of an elastic member, such as conductive rubber. The roller shaft of the transfer roller 30 extends in the direction parallel to the drum shaft of the photoconductive drum 16. During image transfer, transfer bias is applied to the transfer rollers 30. Each transfer roller 30 rotates in the counterclockwise direction in FIG. 1 so that the transfer roller 30 moves in the same direction as the moving direction of the conveying belt 29 at the contact point between the transfer roller 30 and the conveying belt 29.

The sheet 3 supplied from the sheet feeding unit 4 is fed from the front side to the rear side by the conveying belt 29 circulated by the drive roller 27 and the driven roller 28, which is driven by the drive roller 27, so as to sequentially pass through image forming positions between the conveying belt 29 and the drums 16 of the process units 13. The color toner images carried on the photoconductive drums 16 of the respective process units 13 are transferred onto the sheet 3 while the sheet 3 passes between the image forming positions. Thus, a color image is formed on the sheet 3.

More specifically, as the yellow toner image carried on the surface of the photoconductive drum 16 of the yellow process units 13Y is transferred on the sheet 3, the magenta toner image carried on the surface of the photoconductive drum 16 of the magenta process units 13M is then transferred onto the sheet 3 having the yellow toner image transferred thereon. Similarly, the cyan and black toner images carried on the surfaces of the photoconductive drums 16 of the cyan and black process units 13C, 13K, respectively, are transferred onto the sheet 3. Thus, each of the different colored images is laid on top of each other.

The color laser printer 1 is a tandem printer having the process units 13 in association with the toner colors. Therefore, the color laser printer 1 can print in color at substantially the same speed as in monochrome, by forming a toner image of each color in the respective process units 13. Thus, the speedy color image formation can be achieved.

(6) Fixing Section

The fixing section 15 is disposed behind the transfer section 14. The fixing section 15 includes a heat roller 31, a pressure roller 32 and a pair of feeding rollers 33. The heat roller 31 is made of a metal tube on which a release layer is formed and includes a halogen lamp along its axial direction. The surface of the heat roller 31 is heated to a fixing temperature by the halogen lamp. The pressure roller 32 is disposed to press the heat roller 31. The feeding rollers 33 are disposed behind the heat roller 31 and the pressure roller 32.

The sheet 3 having a color image transferred thereon is then fed to the fixing section 15 where the color image is thermally fixed thereon by the application of heat and pressure while the sheet 3 passes between the heat roller 31 and the pressure roller 32. The sheet 3 having the color image thermally fixed thereon is then conveyed to the sheet output unit 6.

(7) Sheet Output Unit

The sheet output unit 6 includes a sheet output path 34, sheet output rollers 35, and a sheet output tray 36.

The sheet output path 34 is formed in a substantially "U" shaped manner with the upstream end of the sheet output path 34 with respect to the sheet feeding direction being disposed adjacent to the feeding rollers 33 at a lower position and with the downstream end of the sheet output path 34 being disposed adjacent to the sheet output rollers 35 at a higher position. In the sheet output path 34, the sheet 3 is fed rearward and then frontward in a U-shaped manner.

A pair of sheet output rollers 35 is disposed on a downstream end of the sheet output path 34.

The sheet output tray 36 is formed on the upper face of the main body casing 2 at an angle such that the tray 36 extends downward from its front side to its rear side.

The sheet 3 fed from the feeding rollers 33 is U-turned in the sheet output path 34 and fed frontward by the sheet output rollers 35. Then, the sheet 3 is output to the sheet output tray 36.

Figure 2:
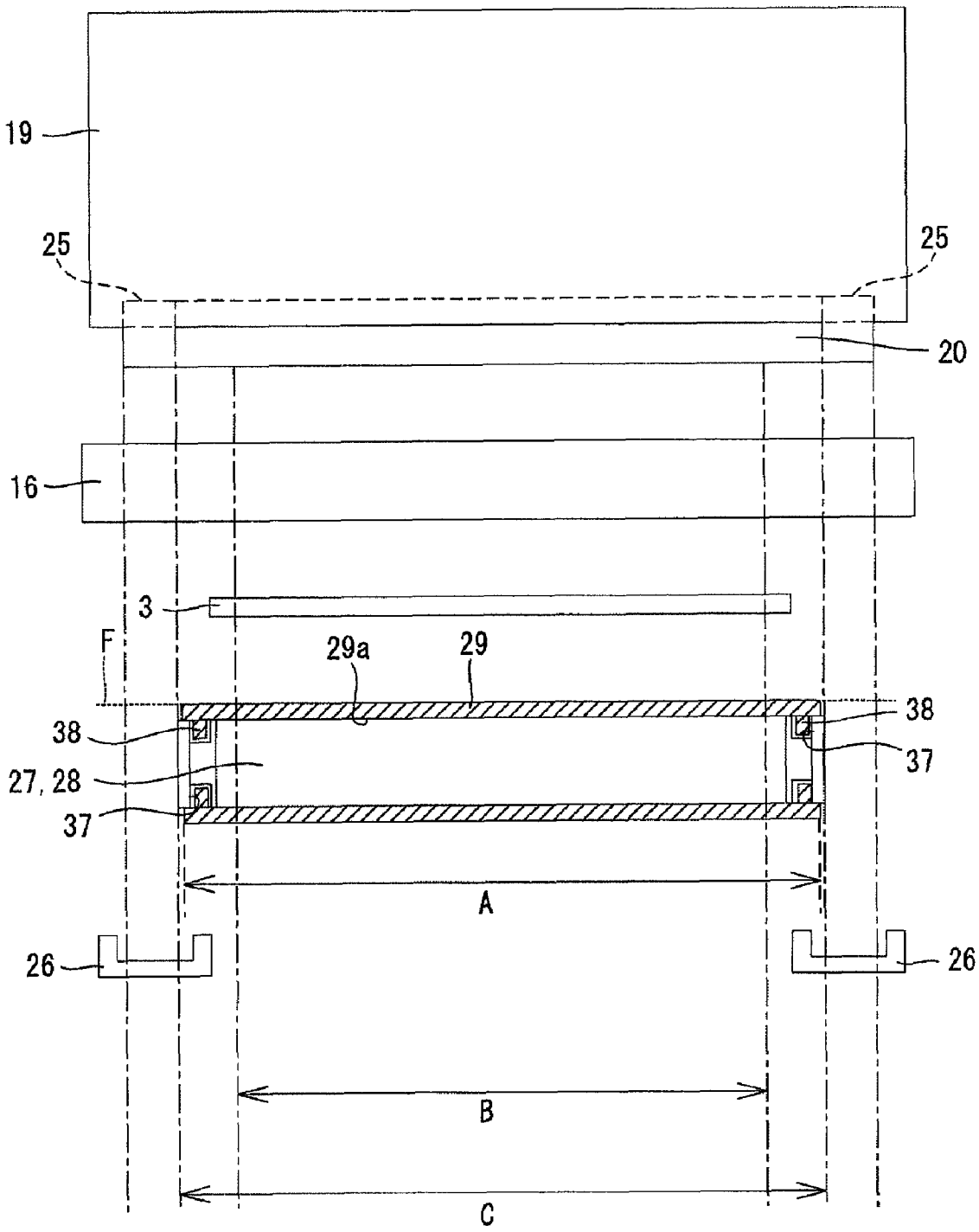
FIG. 2 is a schematic showing a drive roller, a driven roller, and a conveying belt shown in FIG. 1.

2. Detailed Structure of Illustrative Drive Roller, Driven Roller and Conveying Belt As shown in FIG. 2, the drive roller 27 and the driven roller 28 are rotatably supported on an axis extending along a width direction (right-left direction in FIG. 2) of the conveying belt 29. For example, the drive roller 27 and the driven roller 28 have a length substantially equal to a distance C between the side seal members 25 disposed at each end of the peripheral surface of the developing roller 20. A groove 37 having a recess shape in a sectional view is formed around the peripheral surface of the drive roller 27 and the driven roller 28 at each end thereof.

The conveying belt 29 has a belt width A as indicated in FIG. 2. The belt width A is wider than a width B of a maximum toner image forming area in the drum 16 (width of maximum printable area B) and shorter than the length of the developing roller 20 where it does not contact the side seal members 25 (the distance C between the side seal members 25). A plane F, as shown in FIG. 2, parallel to an axis of the photoconductive drum 16 is assumed on the surface of the conveying belt 29. When the side seal members 25 are projected onto the plane F, the conveying belt 29 does not exist in areas of projection of the side seal members 25. Therefore, the conveying belt 29 does not contact the photoconductive drum 16 at the projection areas.

The belt width A of the conveying belt 29 is set to a distance or length to cover the grooves 37 formed around the peripheral surface of the drive roller 27 and the driven roller 28 at each end thereof. Rib-like guides 38 are formed on a surface (inner surface) of the conveying belt 29 facing the peripheral surface of the drive roller 27 and the driven roller 28. The guides 38 are provided all around the conveying belt 29 on its inner surface at a position outside the width B of the maximum printable area in the photoconductive drum 16. The guides 38 engage with the grooves 37 and guide the movement or the circulation of the conveying belt 29 by the drive roller 27 and the driven roller 28.

The conveying belt 29 is formed shorter, with respect to its width direction perpendicular to the transporting or traveling direction of the conveying belt 29, than the distance C between the side seal members 25, where the developing roller 20 does not contact the side seal members 25. Therefore, even when the toner leaks from the case 19 through the side seal members 25, the leaked toner passes outside the ends of the conveying belt 29 with respect to its width direction. Thus, attachment of the leaked toner to the conveying belt 29 may be prevented. Consequently, attachment of the leaked toner to the photoconductive drums 16 disposed on the downstream side in the transporting or traveling direction of the conveying belt 29 may be reliably prevented. Therefore, the side seal members 25 that slide on the peripheral surface of the developing roller 20 may avoid being contaminated with the different colors of the toner. Further, the color toner contained in the case 19 may be prevented from being mixed with the different colors of the leaked toner. If the side seal members 25 are contaminated with the different colors of toner, its sealing effects may be reduced. Therefore, the toner leakage may be induced or likely to occur in the contaminated case 19. However, in the above-described structure, induction of the toner leakage may be prevented.

Further, even when the toner leaks from the case 19 through the side seal members 25, the leaked toner may be received by the containers 26. Thus, spatters of the leaked toner in the color laser printer 1 may be prevented. Thus, contamination in the color laser printer 1 may be prevented.

The conveying belt 29 circulates along its transporting or traveling direction while the guides 38 engage with the grooves 37 formed on the ends of the peripheral surface of the drive roller 27 and the driven roller 28. Thus, the shift or movement of the belt 29 in the width direction may be prevented. The guides 38 are disposed on the conveying belt 29 outside the areas where the conveying belt 29 contacts the maximum printable area on the photoconductive drum 16. Thus, stable developing of the electrostatic latent image may be performed.

Further, the conveying belt 29 conveys the sheet 3 to which the toner image is transferred directly from the photoconductive drums 16. Because each color toner image can be transferred directly to the sheet 3, speedy color image formation can be achieved.

Illustrative aspects of the invention will be described with reference to FIG. 3. It should be noted that like numerals represent like components and detailed explanation thereof with respect to FIG. 3 is omitted.

Figure 3:
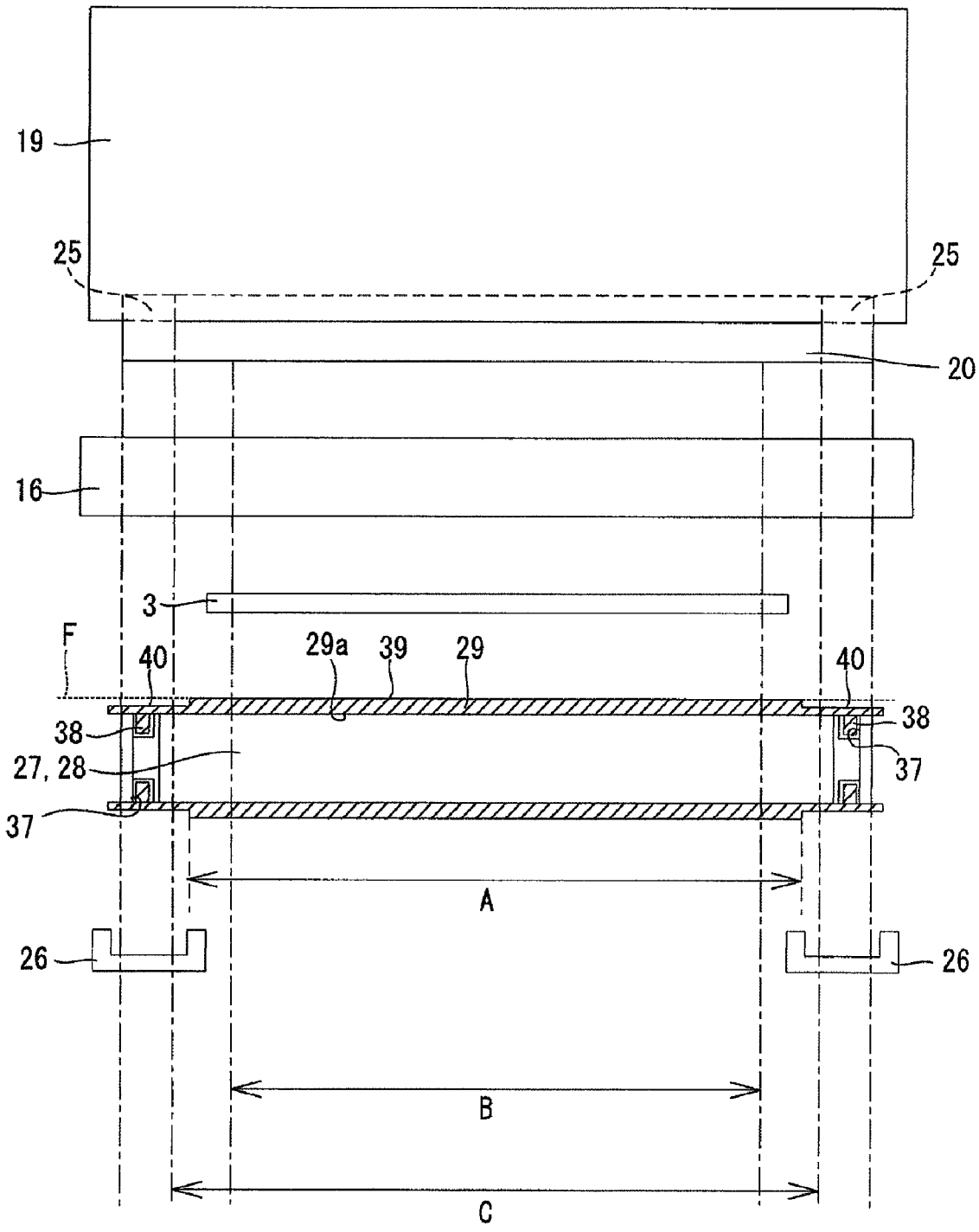
FIG. 3 is a schematic showing a drive roller, a driven roller, and a conveying belt, according to at least one aspect of the invention in which a thickness of the conveying belt at each end is thinner than that of the conveying belt at its central portion.

As shown in FIG. 3, the drive roller 27 and the driven roller 28 are formed such that their lengths are almost the same as the length of the developing roller 20.

The conveying belt 29 is formed to have a width longer than the lengths of the drive roller 27 and the driven roller 28. The conveying belt 29 has a central portion 39 whose thickness is thicker than that of each end portion 40 of the conveying belt 29. The photoconductive drum 16 contacts only the relatively thick central portion 39 of the belt 29.

The central portion 39 has a width A wider or longer than the width B of the maximum printable area in the photoconductive drum 16 and shorter than the distance C between the side seal members 25 where the developing roller 20 does not contact the side seal members 25. When the side seal members 25 are projected onto the plane F, the conveying belt 29 does not contact the photoconductive drum 16 at the projection areas.

With such a structure, even when the toner leaks from the case 19 through the side seal members 25, the toner may adhere to the end portions 40 of the conveying belt 29, which are formed thinner than the central portion 39 that the photoconductive drum 16 contacts. Therefore, the leaked toner may be prevented from attaching to the downstream photoconductive drums 16 with respect to the transporting direction of the conveying belt 29.

Figure 4:
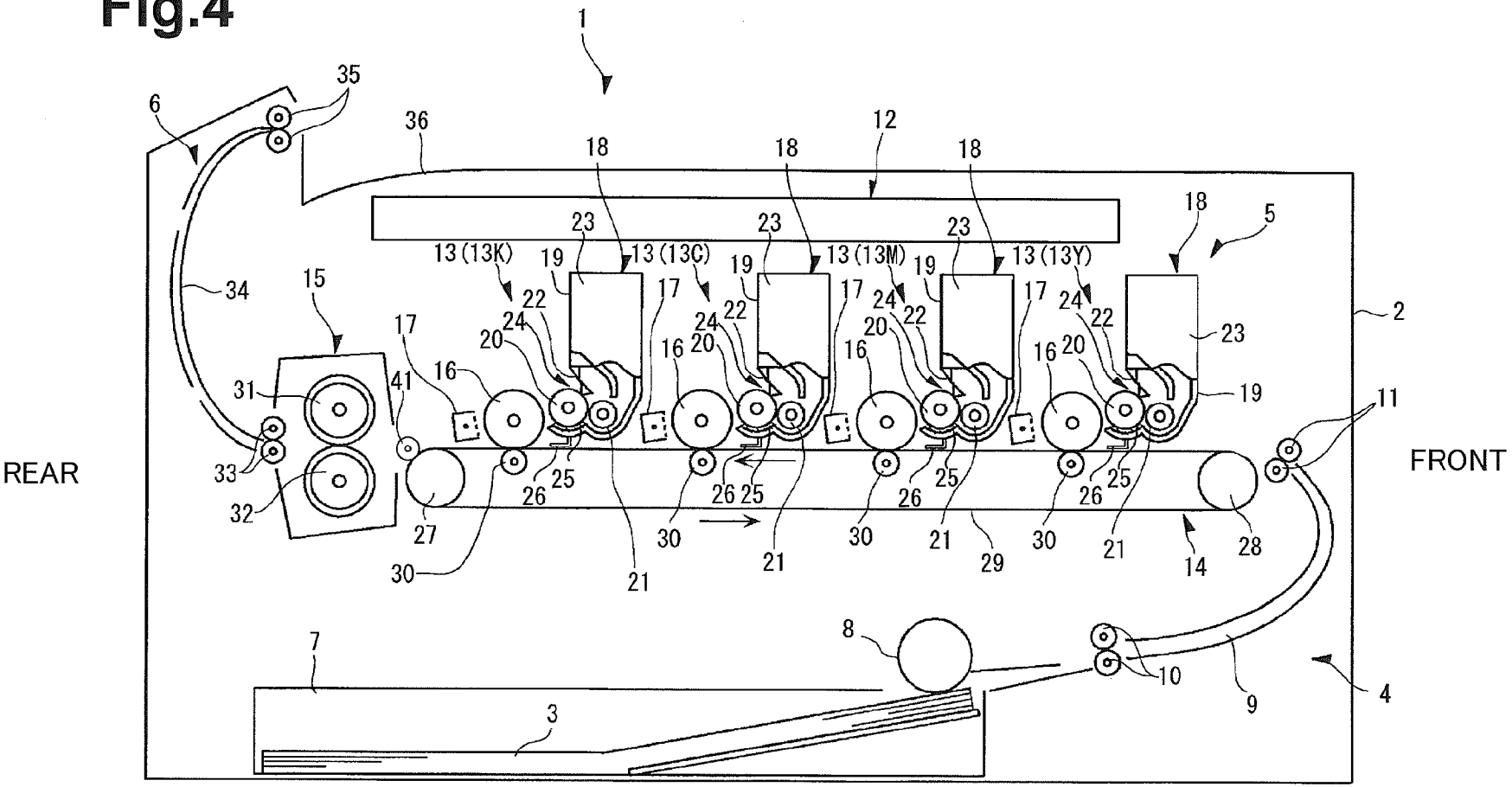
FIG. 4 is a sectional side view of a color laser printer according to at least one aspect of the invention in which each end of the conveying belt is pressed by a pressing roller.

Further aspects of the invention will be described with reference to FIGS. 4 and 5. It should be noted that numerals in FIG. 4, similar to those in FIG. 1 represent corresponding components and numerals in FIG. 5, similar to those in FIG. 3 represent corresponding components and a detailed explanation thereof with respect to FIGS. 4 and 5 is omitted.

Figure 5:
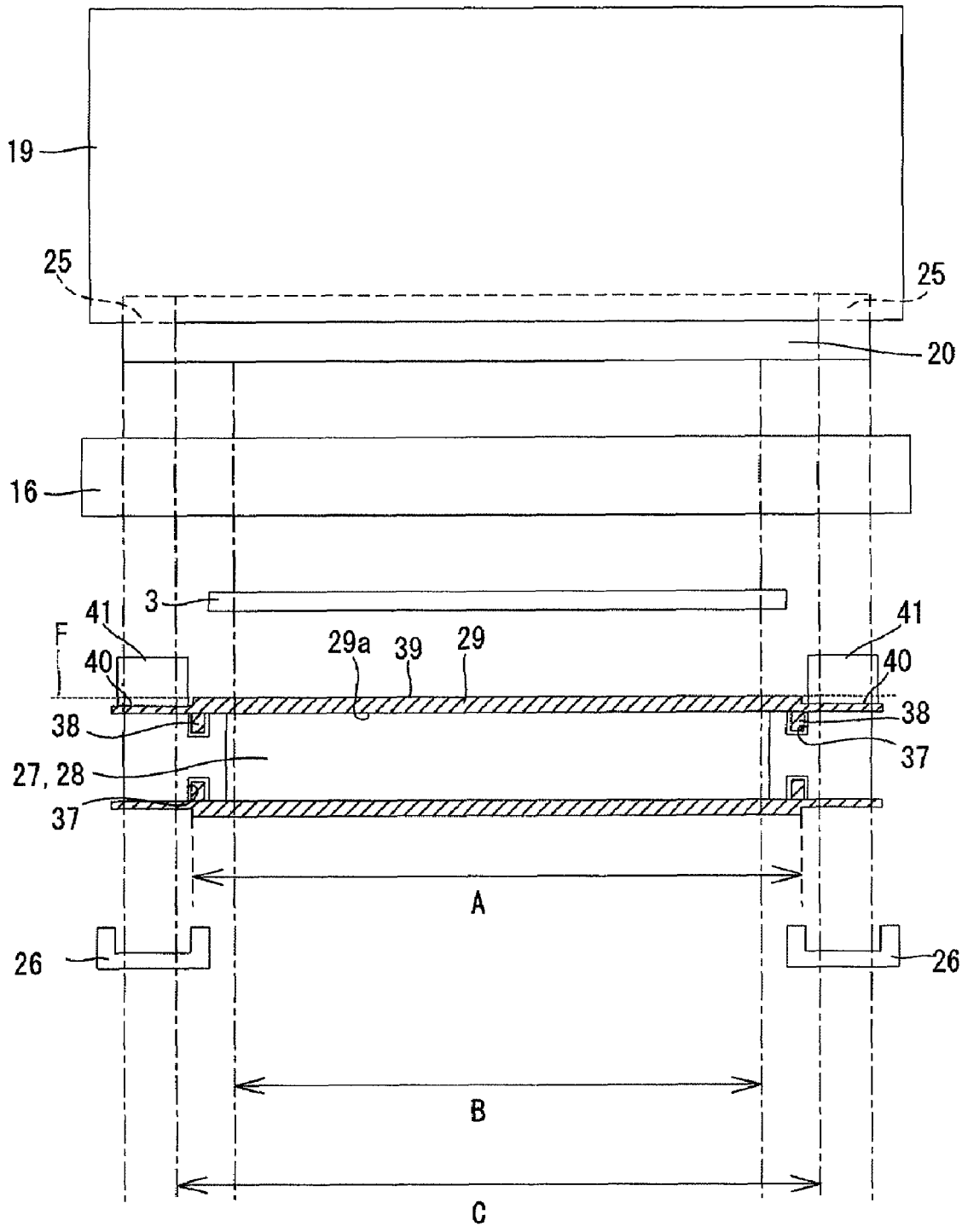
FIG. 5 is a schematic showing a drive roller, a driven roller, and a conveying belt of the color laser printer shown in FIG. 4.

In the color laser printer 1 according to at least one illustrative aspect, the drive roller 27 and the driven roller 28 are formed to have a length almost the same as the length of the developing roller 20, as shown in FIG. 5. The width of the conveying belt 29 is wider or longer than the lengths of the drive roller 27 and the driven roller 28.

The transfer section 14 of the color laser printer 1 includes pressing rollers 41 for pressing the conveying belt 29 at its each end. The pressing rollers 41 are disposed on an upper rear side of the drive roller 27, as will be best seen in FIG. 4, at each end of the conveying belt 29 with respect to its width direction. The pressing rollers 41 press the conveying belt 29 at a predetermined pressure to push down or lower each end of the conveying belt 29 with respect to its width direction. The pressing rollers 41 have a width wider than the width of the side seal members 25 that slide with the peripheral surface of the developing roller 20.

Thus, the conveying belt 29 has a relatively thick central portion 39 and relatively thin end portions 40. The photoconductive drums 16 contact only the relatively thick central portion 39.

Because the pressing rollers 41 have a width wider than the width of the side seal members 25, the central portion 39 has a width A wider or longer than the width B of maximum printable area in the photoconductive drum 16 and shorter than the distance C between the side seal members 25 where the developing roller 20 does not contact the side seal members 25. When the side seal members 25 are projected onto the plane F, the conveying belt 29 does not contact the photoconductive drum 16 at the projection areas.

With such a structure, even when the toner leaks from the case 19 through the side seal members 25, the toner may adhere to the end portions 40 of the conveying belt 29 that are lowered or are pushed down in a direction away from the photoconductive drum 16. Therefore, the leaked toner may be reliably prevented from being attached to the downstream photoconductive drums 16 with respect to the transporting direction of the conveying belt 29.

Further, the pressing rollers 41 press the end portions 40 of the conveying belt 29 against the drive roller 27. Thus, each end 40 of the conveying belt 29 may reliably be lowered or be pushed down in a direction away from the photoconductive drum 16.

While the invention has been described in connection with illustrative aspects, it will be understood by those skilled in the art that other variations and modifications of the aspects described above may be made without departing from the scope of the invention. Other aspects will be apparent to those skilled in the art from a consideration of the specification or practice of the invention disclosed herein. It is intended that the specification and the described examples only are illustrative with the true scope of the invention being defined by the following claims.

What is claimed is:

1. A color image forming apparatus configured to form a color image using plural colors of developer, comprising:

photoconductor elements linearly arranged in association with each color of the developer, each photoconductor element configured to have an electrostatic latent image of corresponding color formed thereon;

developing rollers provided in association with each photoconductor element, each developing roller configured to supply the developer to the associated photoconductor element and to develop the electrostatic latent image into a developer image;

a plurality of cases, each case associated with a corresponding photoconductor element and configured to hold the developer to be supplied to the corresponding photoconductor element from the developing roller, and each case having an elongated opening in which the developing roller is disposed;

a side seal member disposed at each end of the elongated opening of each case with respect to a longitudinal direction of the elongated opening, each side seal member contacting a peripheral surface of the developing roller at each end of an axial direction of the developing roller; and a belt configured to move in a transporting direction parallel to an arrangement direction of the photoconductor elements, the belt being disposed below the developing rollers so as to face the photoconductor elements;

wherein the belt is disposed so as not to contact any of the photoconductor elements in an area defined by the side seal members being projected onto a plane on a surface of the belt, the plane being parallel to an axis of the photoconductor elements.

2. The color image forming apparatus according to claim 1, wherein in a direction perpendicular to the transporting direction of the belt, the belt has a width shorter than a length of each developing roller and greater than a developer image forming area on each photoconductor element.

3. The color image forming apparatus according to claim 1, wherein each end of the belt in a direction perpendicular to the transporting direction of the belt is thinner than a central portion of the belt, the central portion contacting a peripheral surface of the photoconductor elements.

4. The color image forming apparatus according to claim 1, wherein the belt is forced down in a direction away from each photoconductor element at each end of the belt with respect to a direction perpendicular to the transporting direction of the belt.

5. The color image forming apparatus according to claim 4, further comprising:

a plurality of transporting rollers around which the belt is looped; and a pressing member disposed opposite to at least one of the transporting rollers, the pressing member being configured to press the belt toward the at least one of the transporting rollers at each end of the belt in the direction perpendicular to the transporting direction.

6. The color image forming apparatus according to claim 1, further comprising containers, each container configured to receive developer leaking from each end of the peripheral surface of a corresponding one of the developing rollers, each container being disposed opposite to a corresponding one of the side seal members.

7. The color image forming apparatus according to claim 1, further comprising:

a transporting roller configured to circulate the belt, the transporting roller having a groove on a peripheral surface thereof; and a guide formed on a surface of the belt facing the transporting roller, the guide being configured to engage with the groove to guide the belt to move, wherein the guide is disposed on the belt outside a developer image forming area on each photoconductor element.

8. The color image forming apparatus according to claim 1, wherein the belt includes a portion configured to convey a recording medium to which the developer image on each photoconductor element is transferred.

* * * * *